US005496423A

United States Patent [19]

Wyatt-Mair et al.

[11] Patent Number: 5,496,423

[45] Date of Patent: Mar. 5, 1996

[54] METHOD OF MANUFACTURING ALUMINUM SHEET STOCK USING TWO SEQUENCES OF CONTINUOUS, IN-LINE OPERATIONS

[75] Inventors: Gavin F. Wyatt-Mair, Lafayette; Donald G. Harrington, Danville, both of Calif.

[73] Assignee: Kaiser Aluminum & Chemical Corporation, Pleasonton, Calif.

[21] Appl. No.: 173,352

[22] Filed: Dec. 23, 1993

Related U.S. Application Data

[63] Continuation-in-part of Ser. No. 902,936, Jun. 23, 1992, abandoned, and a continuation-in-part of Ser. No. 902,718, Jun. 23, 1992, abandoned, and a continuation-in-part of Ser. No. 997,503, Dec. 28, 1992, Pat. No. 5,356,495.

[51] Int. Cl.[6] ..... C22F 1/04

[52] U.S. Cl. ..... 148/551; 148/552; 148/693; 148/697; 148/417; 148/439; 148/440; 164/459; 164/462; 164/476; 164/477

[58] Field of Search ..... 148/551, 552, 148/693, 697, 417, 439, 440; 164/459, 462, 476, 477

[56] References Cited

U.S. PATENT DOCUMENTS

| | | | |
|---|---|---|---|
| 4,282,044 | 8/1981 | Robertson et al. | 148/552 |
| 4,582,541 | 4/1986 | Dean et al. | 148/551 |
| 4,976,790 | 12/1990 | McAuliffe et al. | 148/551 |
| 5,356,495 | 10/1994 | Wyatt-Mair et al. | 148/551 |

*Primary Examiner*—David A. Simmons
*Assistant Examiner*—Robert R. Koehler
*Attorney, Agent, or Firm*—Rockey, Rifkin and Ryther

[57] ABSTRACT

A method for manufacturing aluminum alloy sheet stock including two sequences of continuous, in-line operations. The first sequence includes the continuous, in-line steps of hot rolling, coiling, coil self-annealing and the second sequence includes the continuous, in-line steps of uncoiling, quenching without intermediate cooling, cold rolling, and coiling.

21 Claims, 4 Drawing Sheets

Two-Sequence Can Stock Production

METHOD OF MANUFACTURING ALUMINUM SHEET STOCK USING TWO SEQUENCES OF CONTINUOUS, IN-LINE OPERATIONS

CROSS REFERENCE TO RELATED APPLICATIONS

This application is a continuation-in-part of applications Ser. No. 07/902,936 and Ser. No. 07/902,718, both now abandoned, and both filed Jun. 23, 1992. The present application is also a continuation-in-part of Ser. No. 07/997,503, filed Dec. 28, 1992, now U.S. Pat. No. 5,356,495.

BACKGROUND OF THE INVENTION

The present invention relates to a two-sequence continuous in-line process for economically and efficiently producing aluminum alloy sheet stock. This application relates to Ser. No. 07/902,718 and represents an alternative in the methodology of annealing.

PRIOR ART

There are three characteristics that are common to prior art processes for manufacturing aluminum sheet stock: a) the width of the stock is wide (typically greater than 60 inches), b) the stock is produced by large plants employing large sophisticated machinery and c) the stock is packaged and shipped long distances to customers. Sheet stock in wide widths has necessarily been produced by a few large, centralized rolling plants. Such plants typically produce many different products, and this necessitates the use of flexible manufacturing on a large scale, with attendant cost and efficiency disadvantages. The width of the product necessitates the use of large-scale machinery in all areas of the sheet stock producing plants, and customer quality requirements dictate that this machinery be sophisticated. Such massive, high-technology machinery represents a significant economic burden, both from a capital investment and an operating cost perspective. Once the sheet stock has been manufactured to finish gauge as described in detail hereinafter, it is carefully packaged to seal against moisture intrusion for shipment to customers facilities. These facilities are typically located remote from the sheet stock manufacturers' plant; indeed, in many cases they are hundreds or even thousands of miles apart. Packaging, shipping, and unpackaging therefore represent a further significant economic burden, especially when losses due to handling damage, atmospheric conditions, contamination and misdirection are added. The amount of product in transit adds significant inventory cost to the prior art process.

Conventional manufacturing of sheet stock employs batch processes which include an extensive sequence of separate steps. In the typical case, a large ingot is cast and cooled to ambient temperature. The ingot is then stored for inventory management. When an ingot is needed for further processing, it is first treated to remove defects such as segregation, pits, folds, liquation and handling damage by machining of its surfaces. This operation is called scalping. Once the ingot has surface defects removed, it is heated to a required homogenization temperature for several hours to ensure that the components of the alloy are uniformly distributed through the metallurgical structure, and then cooled to a lower temperature for hot rolling. While it is still hot, the ingot is subjected to breakdown hot rolling in a number of passes using reversing of the ingot. After breakdown hot rolling, the ingot is then typically supplied to a tandem mill for hot finishing rolling, after which the sheet stock is coiled, air cooled and stored. The coil may be annealed in a batch step. The coiled sheet stock is then further reduced to final gauge by cold rolling using unwinders, rewinders and single and/or tandem rolling mills.

Batch processes typically used in the aluminum industry require many different material handling operations to move ingots and coils between what are typically separate processing steps. Such operations are labor intensive, consume energy, and frequently result in product damage, re-working of the aluminum and even wholesale scrapping of product. And, of course, maintaining ingots and coils in inventory also adds to the manufacturing cost.

Aluminum scrap is generated in most of the foregoing steps, in the form of scalping chips, end crops, edge trim, scrapped ingots and scrapped coils. Aggregate losses through such batch processes typically range from 25 to 40%. Reprocessing the scrap thus generated adds 25 to 40% to the labor and energy consumption costs of the overall manufacturing process.

It has been proposed, as described in U.S. Pat. No. 4,260,419 and 4,282,044 to produce aluminum alloy sheet stock by a process which uses direct chill casting or minimill continuous strip casting. In the process there described, consumer aluminum scrap is remelted and treated to adjust its composition. In one method, molten metal is direct chill cast followed by scalping to eliminate surface defects from the ingot. The ingot is then preheated, subjected to hot breakdown rolling followed by continuous hot rolling, coiling, batch annealing and cold rolling to form the sheet stock. In another method, the casting is performed by continuous strip casting followed by hot rolling, coiling and cooling. Thereafter, the coil is annealed and cold rolled. The minimill process, as described above, requires about ten material handling operations to move ingots and coils between about nine process steps. Like other conventional processes described earlier, such operations are labor intensive, consume energy and frequently result in product damage. Scrap is generated in the rolling operations resulting in typical losses throughout the process of about 10 to 20%.

In the minimill process, annealing is typically carried out in a batch fashion with the aluminum in coil form. Indeed, the universal practice in producing aluminum alloy flat rolled products has been to employ slow air cooling of coils after hot rolling. Sometimes the hot rolling temperature is high enough to allow recrystallization of the hot coils as the aluminum cools down. Often, however, a furnace coil batch anneal must be used to effect recrystallization before cold rolling. Batch coil annealing as typically employed in the prior art requires several hours of uniform heating and soaking to achieve recrystallization. Alternatively, after breakdown cold rolling, prior art processes frequently employ an intermediate anneal operation prior to finish cold rolling. During slow cooling of the coils following annealing, some alloying elements which had been in solid solution in the aluminum will precipitate, resulting in reduced strength attributable to solid solution hardening.

The foregoing patents (U.S. Pat. No. 4,260,419 and U.S. Pat. No. 4,292,044) employ batch coil annealing, but suggest the concept of flash annealing in a separate processing line. These patents suggest that it is advantageous to slow cool the alloy after hot rolling and then reheat it as part of a flash annealing process. That flash annealing operation has been criticized in U.S. Pat. No. 4,614,224 as not economical.

There is thus a need to provide a continuous, in-line process for producing aluminum alloy sheet stock which avoids the unfavorable economics embodied in conventional processes of the types described.

It is accordingly an object of the present invention to provide a process for producing heat treated aluminum alloy sheet stock which can be carried out without the need for either a batch annealing furnace or a flash annealing furnace.

It is a more specific object of the invention to provide a process for commercially producing heat treated aluminum alloy sheet stock in a two-sequence continuous process which can be operated economically and provide a product having equivalent or better metallurgical properties.

These and other objects and advantages of the invention appear more fully hereinafter from a detailed description of the invention.

SUMMARY OF THE INVENTION

The concepts of the present invention reside in the discovery that it is possible to produce heat treated aluminum alloy sheet stock in a two-stage continuous process having the following operations combined in the two sequences of two continuous lines. The first sequence includes the continuous, in-line steps of casting, hot rolling, coiling and self-annealing; the second sequence includes the continuous, in-line steps of uncoiling while still hot, quenching, cold rolling and coiling. This process eliminates the capital cost of an annealing furnace while obtaining strength associated with heat treatment. The two-step operation in place of many step batch processing facilitates precise control of process conditions and therefore metal-lurgical properties. Moreover, carrying out the process steps continuously and in-line eliminates costly materials handling steps, in-process inventory and losses associated with starting and stopping the processes.

The process of the present invention thus involves a new method for the manufacture of heat treated aluminum alloy sheet stock utilizing the following two continuous in-line sequences:

Stage one having in-line the following continuous operations:

(a) A hot aluminum feedstock is provided, such as by strip casting;

(b) The feedstock is hot rolled to reduce its thickness;

(c) The hot reduced feedstock is coiled hot; and (d) The hot reduced feedstock is thereafter held in coil form at the hot rolling exit temperature (or a few degrees lower as temperature decays) for 2 to 120 minutes to effect recrystallization and solutionization without intermediate heating;

Stage two has the following in-line continuous operations:

(a) Uncoiling hot product;

(b) Quenching the annealed product immediately and rapidly to a temperature suitable for cold rolling;

(c) Cold rolling the quenched feedstock to produce sheet stock having desired thickness and metallurgical properties; and (d) Coiling or an alternate operation such as blanking or shearing.

In accordance with a preferred embodiment of the invention, the strip is fabricated by strip casting to produce a cast thickness less than 1.0 inch, and preferably within the range of 0.05 to 0.2 inches.

In another preferred embodiment, the width of the strip, slab or plate is narrow, contrary to conventional wisdom; this facilitates ease of in-line threading and processing, minimizes investment in equipment and minimizes cost in the conversion of molten metal to sheet stock.

In a further preferred embodiment, resulting favorable capacity and economics mean that small dedicated sheet stock plants may conveniently be located at facilities utilizing the sheet stock, further avoiding packaging and shipping of sheet stock and scrap, and improving the quality of the sheet stock as seen by the customer.

DETAILED DESCRIPTION OF THE INVENTION

In the preferred embodiment, the overall process of the present invention embodies three characteristics which differ from the prior art processes;

(a) The width of the sheet stock product is narrow;

(b) The sheet stock is produced by utilizing small, in-line, simple machinery; and (c) The said small sheet stock plants are located in or adjacent to the customers plants, and therefore packaging and shipping operations are eliminated.

The in-line arrangement of the processing steps in a narrow width (for example, 12 inches) make it possible for the invented process to be conveniently and economically located in or adjacent to facilities using the sheet stock.

Figure 1:
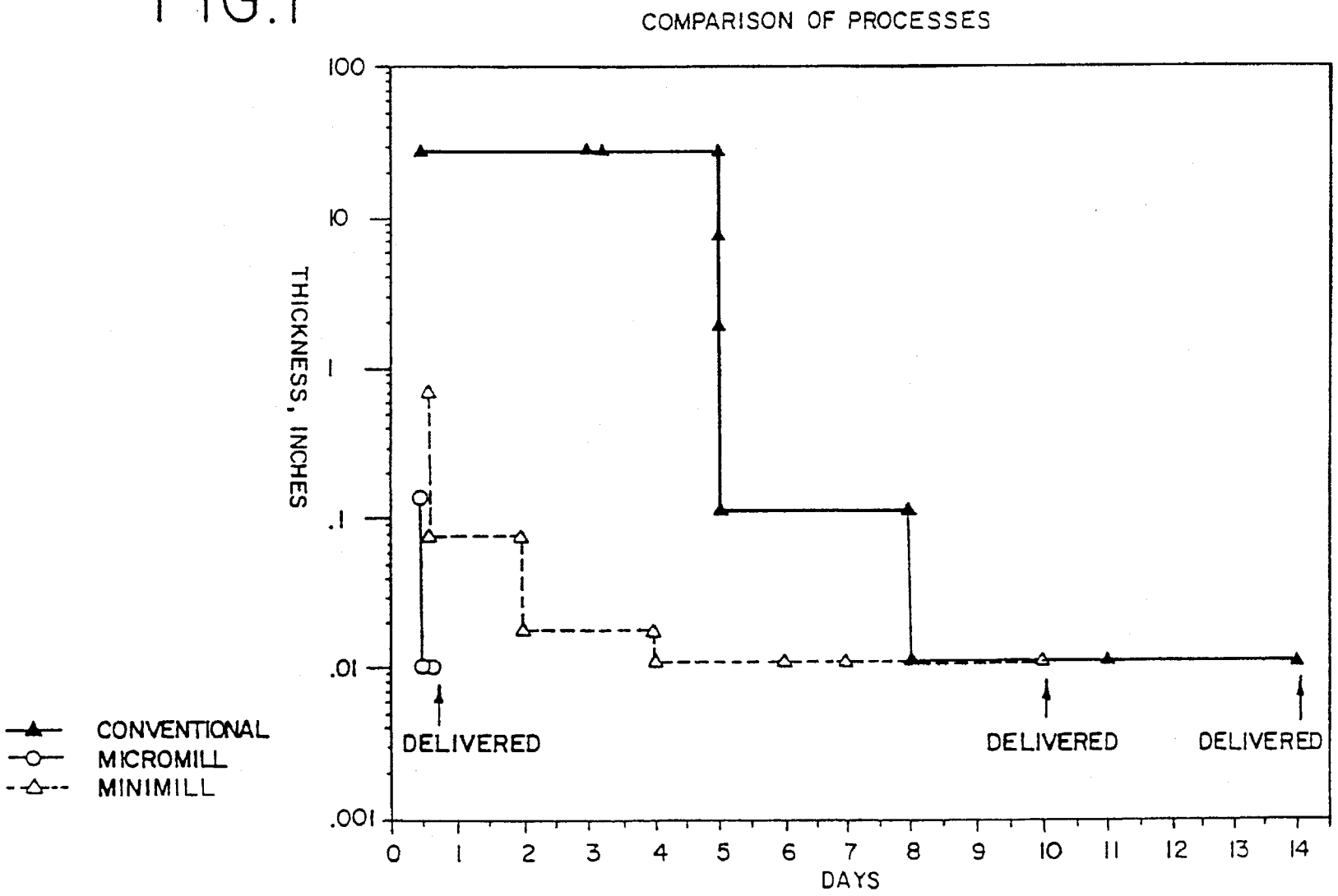
FIG. 1 is a plot of in-process thickness versus time for conventional minimill, and the two-step "micromill" process of the present invention.
Figure 2:
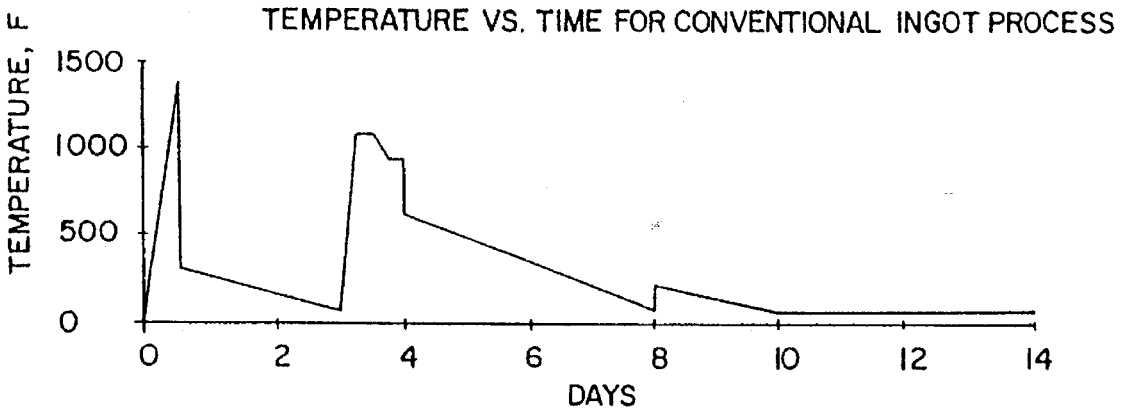
FIG. 2 is a plot of temperature versus time for the present invention, referred to as the two-step micromill process, as compared to two prior processes.
Figure 2:
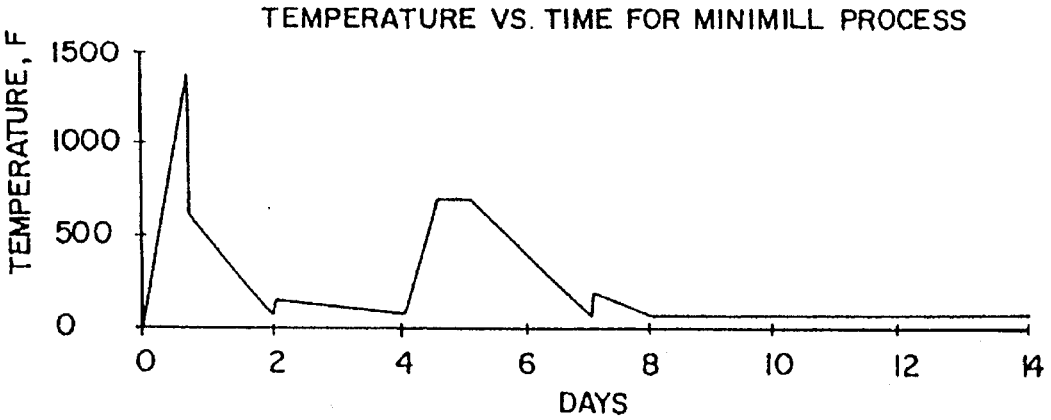
Figure 2:
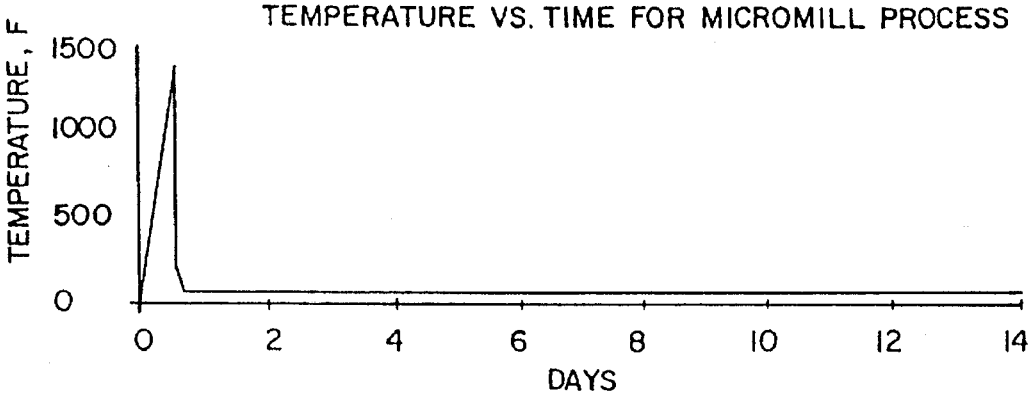

As can be seen from the foregoing prior art patents, the batch processing technique involves fourteen separate steps while the minimill prior art processing involves about nine separate steps, each with one or more handling operations. The present invention is different from that prior art by virtue of in-line flow of product through the fabrication operations involving only two or three handling steps and the metallurgical differences that the method produces as discussed hereinafter. FIG. 1 shows the thickness of in-process product during manufacture for conventional, minimill, and micromill processes. The conventional method starts up to 30-in.-thick ingots and takes 14 days. The minimill process starts at 0.75-in.-thick and takes 9 days. The micromill process starts at 0.140-in. and takes ½ day (most of which is the melting cycle, since the in line process itself takes less than two hours). The symbols in FIG. 1 represent major processing and/or handling steps. FIG. 2 compares typical in-process product temperature for three methods of producing can body stock. In the conventional ingot method, there is a period for melting followed by a rapid cool during casting with a slow cool to room temperature thereafter. Once the scalping process is complete, the ingot is heated to homogenization temperature before hot rolling. After hot rolling, the product is again cooled to room temperature. At this point, it is assumed in the figure that the hot rolling temperature and slow cool were sufficient to anneal the product. However, in some cases, a batch anneal step of about 600° F. is needed at about day 8 which extends the total process schedule an additional two days. The last temperature increase is associated with cold rolling, and it is allowed to cool to room temperature.

In the minimill process, there is again a period of melting, followed by rapid cooling during slab casting and hot rolling, with a slow cool to room temperature thereafter. Temperature is raised slightly by breakdown cold rolling and the product is allowed to cool again slowly before being heated for batch annealing. After batch annealing, it is cooled slowly to room temperature. The last temperature increase is associated with cold rolling and it is allowed to cool to room temperature.

In the micromill process of the preferred embodiment of the present invention, there is in-line melting, strip casting, hot rolling, and coiling. Immediately after recrystallization, which in the preferred embodiment takes several minutes, the hot-rolled coil is processed through a second in-line sequence of uncoiling, quenching, cold rolling, and coiling.

As can be seen from FIG. 2, the present invention differs substantially from the prior art in duration, frequency and rate of heating and cooling. As will be appreciated by those skilled in the art, these differences represent a significant departure from prior art practices for manufacturing aluminum alloy can body sheet.

Figure 3:
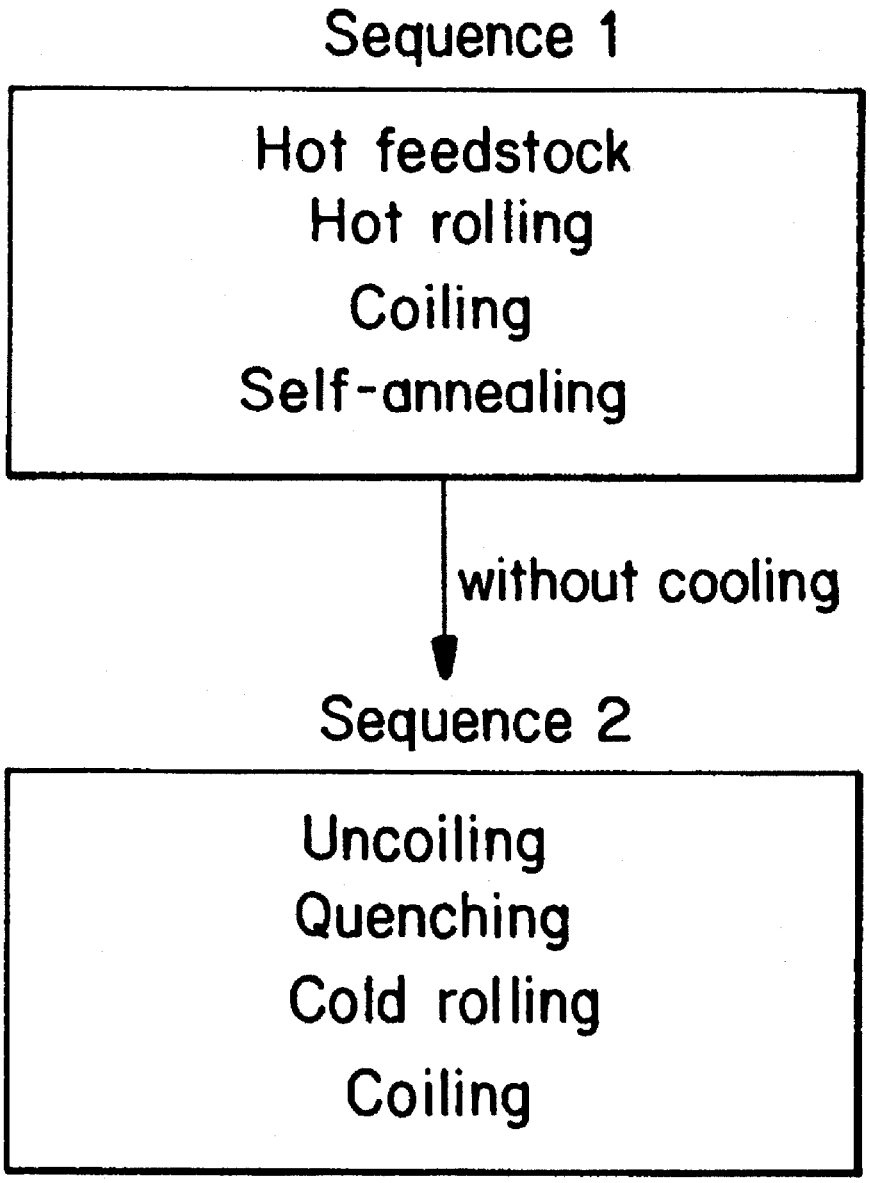
FIG. 3 is a block diagram showing the two-step process of the present invention for economical production of aluminum sheet.
Figure 4:
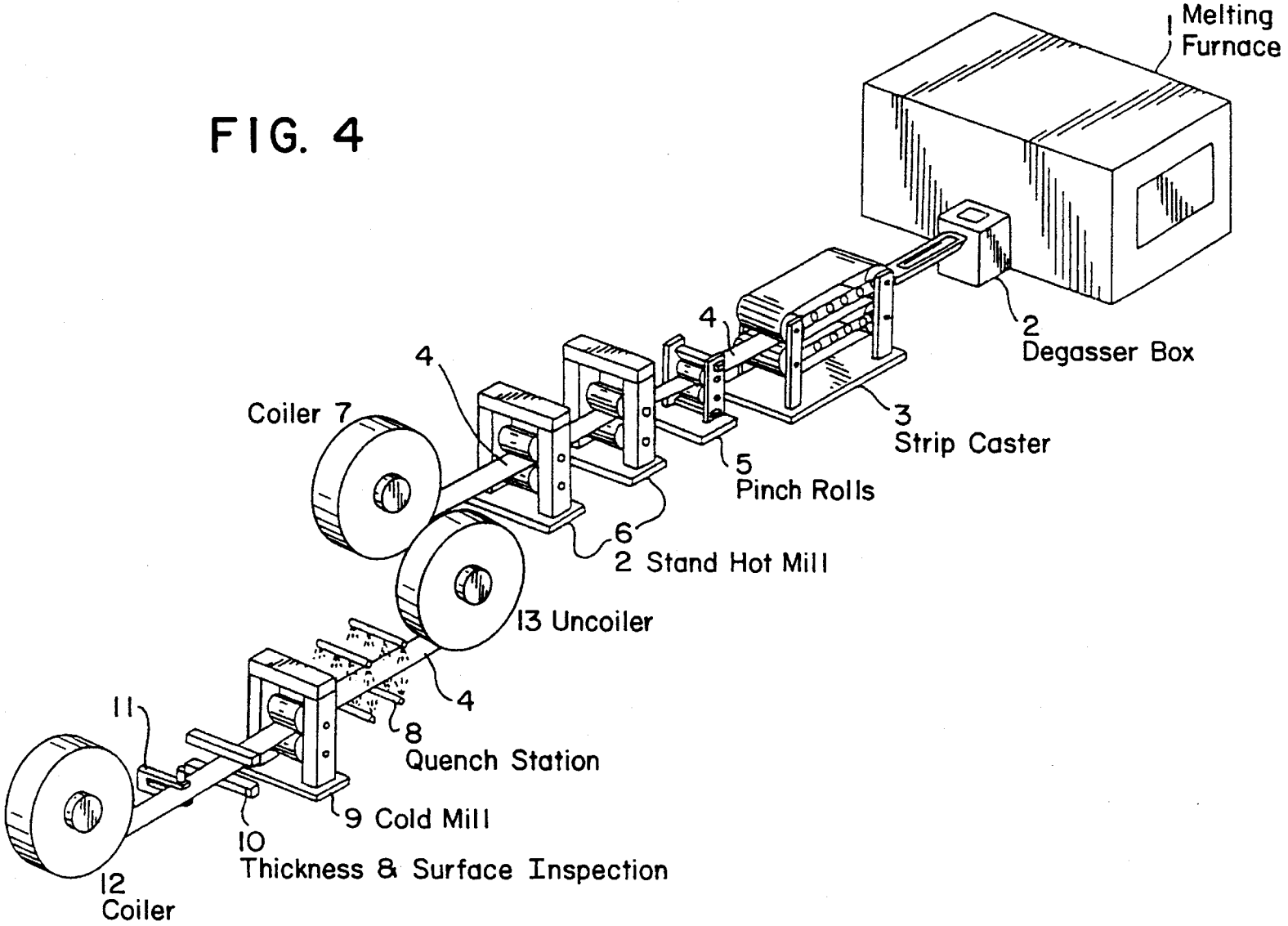
FIG. 4 shows a schematic illustration of the present invention with two in-line processing sequences from casting throughout finish cold rolling.

In the preferred embodiment of the invention as illustrated in FIGS. 3 and 4, the sequence of steps employed in the practice of the present invention is illustrated. One of the advances of the present invention is that the processing steps for producing aluminum sheet stock can be arranged in two continuous steps whereby the various processes are carried out in sequence. Thus, numerous handling operations are entirely eliminated.

In the preferred embodiment, molten metal is delivered from a furnace 1 to a metal degassing and filtering device 2 to reduce dissolved gases and particulate matter from the molten metal, as shown in FIG. 4. The molten metal is immediately converted to a cast feedstock 4 in casting apparatus 3. As used herein, the term "feedstock" refers to any of a variety of aluminum alloys in the form of ingots, plates, slabs and strips delivered to the hot rolling step at the required temperatures. Herein, an aluminum "ingot" typically has a thickness ranging from about 6 inches to about 30 inches, and is usually produced by direct chill casting or electromagnetic casting. An aluminum "plate", on the other hand, herein refers to an aluminum alloy having a thickness from about 0.5 inches to about 6 inches, and is typically produced by direct chill casting or electromagnetic casting alone or in combination with hot rolling of an aluminum alloy. The term "slab" is used herein to refer to an aluminum alloy having a thickness ranging from 0.375 inches to about 3 inches, and thus overlaps with an aluminum plate. The term "strip" is herein used to refer to an aluminum alloy, typically having a thickness less than 0.375 inches. In the usual case, both slabs and strips are produced by continuous casting techniques well known to those skilled in the art.

The feedstock employed in the practice of the present invention can be prepared by any of a number of casting techniques well known to those skilled in the art, including twin belt casters like those described in U.S. Pat. No. 3,937,270 and the patents referred to therein. In some applications, it is desirable to employ as the technique for casting the aluminum strip the method and apparatus described in application Ser. No. 07/902,997 filed Jun. 23, 1992, the disclosure of which is incorporated herein by reference.

The present invention contemplates that any one of the above physical forms of the aluminum feedstock may be used in the practice of the invention. In the most preferred embodiment, however, the aluminum feedstock is produced directly in either slab or strip form by means of continuous casting.

The feedstock 4 is moved through optional pinch rolls 5 into hot rolling stands 6 where its thickness is decreased. The hot reduced feedstock 4 exists the hot rolling stands 6 and is then passed to coiler 7.

While the hot reduced feedstock 4 is held on coiler 7 for 2 to 120 minutes at the hot rolling exit temperature and during the subsequent decay of temperature it undergoes self-annealing. As used herein, the term "self-anneal" refers to a heat treatment process, and includes recrystallization, solutionization and strain recovery. During the hold time on the coil, insulation around the coil may be desirable to retard the decay of temperature.

It is an important concept of the invention that the feedstock 4 be immediately passed to the coiler 7 for annealing while it is still at an elevated temperature from the hot rolling operation of mills 6 and not allowed to cool to ambient temperature. In contrast to the prior art teaching that slow cooling to ambient temperature following hot rolling is metallurgically desirable, it has been discovered in accordance with the present invention that it is not only more thermally efficient to utilize self-annealing but also, combined with quenching, it provides much improved strength over conventional batch annealing and equal or better metallurgical properties compared to on-line or off-line flash annealing. Immediately following the prescribed hold time coiler 7 and uncoiler 13, the coil is unwound continuously, while hot, to quench station 8 where the feedstock 4 is rapidly cooled by means of a cooling fluid to a temperature suitable for cold rolling. In the most preferred embodiment, the feedstock 4 is passed from the quenching station to one or more cold rolling stands 9 where the feedstock 4 is worked to harden the alloy. After cold rolling, the strip or slab 4 is coiled on a coiler 12.

It is also possible to employ appropriate automatic control apparatus; for example, it is frequently desirable to employ a surface inspection device 10 for on-line monitoring or surface quality. In addition, a thickness measurement device 11 conventionally used in the aluminum industry can be employed in a feedstock loop for control of the process.

It is an important concept of the present invention that coil self-annealing (immediately after hot rolling of the feedstock 4 without significant intermediate cooling) be followed by quenching. The sequence and timing of process steps in combination with the heat treatment and quenching operations provide equivalent or superior metallurgical characteristics in the final product compared to ingot methods. In the prior art, the industry has normally employed slow air cooling after hot rolling. Only in some installations is the hot rolling temperature sufficient to cause full annealing by complete recrystallization of the aluminum alloy before the metal cools down. It is far more common that the hot rolling temperature is not high enough to cause full annealing. In that event, the prior art has employed separate batch annealing steps before and/or after breakdown cold rolling in which the coil is placed in a furnace maintained at a temperature sufficient to cause full recrystallization. The use of such furnace batch annealing operations represents a significant disadvantage. Such batch annealing operations require that the coil be heated for several hours at the correct temperature, after which such coils are typically cooled under ambient conditions. During such slow heating, soaking and cooling of the coils, many of the elements present in the aluminum which had been in solution in the aluminum are caused to precipitate. That in turn results in reduced solid solution hardening and reduced alloy strength.

In contrast, the process of the present invention achieves full recrystallization and retains alloying elements in solid solution for greater strength for a given cold reduction of the product.

In the practice of the invention, the hot rolling exit temperature must be maintained at a high enough temperature to allow self-annealing to occur within two to sixty minutes which is generally in the range of 500F. to 950F. Immediately following self-annealing at those temperatures, the feedstock in the form of strip 4 is water quenched to a temperature necessary to retain alloying elements in solid solution and cold rolled (typically at a temperature less than 300° F.).

As will be appreciated by those skilled in the art, the extent of the reductions in thickness effected by the hot rolling and cold rolling operations of the present invention are subject to a wide variation, depending upon the types of feedstock employed, their chemistry and the manner in which they are produced. For that reason, the percentage reduction in thickness of each of the hot rolling and cold rolling operations of the invention is not critical to the practice of the invention. However, for a specific product, practices for reductions and temperatures must be used. In general, good results are obtainable when the hot rolling operation effects a reduction in thickness within the range of 40 to 99% and the cold rolling effects a reduction within the range of 20 to 75%.

One of the advantages of the method of the present invention arises from the fact that the preferred embodiment utilizes a thinner hot rolling exit gauge than that normally employed in the prior art. As a consequence, the method of the invention obviates the need to employ breakdown cold rolling prior to annealing.

What is claimed is:

1. A method for manufacturing aluminum sheet stock in which the process is carried out in two sequences of continuous, in-line operations comprising in the first sequence, continuously hot rolling a hot aluminum feedstock to reduce its thickness, coiling the hot rolled feedstock while it is hot, holding the hot reduced feedstock at or near the hot rolling exit temperature for at least two minutes to effect recrystallization and solutionization without intermediate heating, and, in the second continuous in-line sequence, the steps of uncoiling the hot coiled feedstock and quenching the annealed feedstock immediately and rapidly to a temperature sufficient for cold rolling.

2. A method as defined in claim 1 wherein the feedstock is provided by continuous strip or slab casting.

3. A method as defined in claim 1 wherein the feedstock is formed by depositing molten aluminum alloy on an endless belt formed of a heat conductive material whereby the molten metal solidifies to form a cast strip, and the endless belt is cooled when it is not in contact with the metal.

4. A method as defined in claim 1 which includes, as a continuous in-line step, cold rolling the quenched feedstock.

5. A method as defined in either claims 3 or 4 which includes the step of coiling the cold rolled feedstock after cold rolling.

6. A method as defined in claim 5 wherein the cooling of the cold rolled sheet stock is in-line.

7. A method as defined in either claims 3 or 4 which includes the further step of forming in-line blanks from the cold rolled feedstock.

8. A method as defined in either claims 3 or 4 which includes the further in-line step of shearing the cold rolled feedstock to lengths.

9. A method as defined in claim 1 wherein the hot rolling reduces the thickness of the feedstock by 40 to 99%.

10. A method as defined in claim 1 wherein the hot rolling of the feedstock is carried out at a temperature within the range of 600° F. to the solidus temperature of the feedstock.

11. A method as defined in claim 1 wherein the annealing and solution heat treating is carried out at a temperature within the range of 750° F. to the solidus temperature of the feedstock.

12. A method as defined in claim 1 wherein the hot rolling exit temperature is within the range of 600° to 1000° F.

13. A method as defined in claim 1 wherein the annealing and solution heat treating is carried out in the range of 2–120 minutes.

14. A method as defined in claim 1 wherein the annealed and solution heat treated feedstock is quenched to a temperature less than 300° F.

15. A method as defined in claim 4 wherein the cold rolling step effects a reduction in the thickness of the feedstock of 20 to 75%.

16. A method for manufacturing aluminum sheet stock in which the process is carried out in two sequences of continuous, in-line operation comprising, in the first sequence, continuously hot rolling a hot aluminum feedstock to reduce its thickness, coiling the hot rolled feedstock while it is hot, holding the hot reduced feedstock at or near the hot rolling exit temperature for at least two minutes to effect recrystallization and solutionization without intermediate heating, and, in the second continuous in-line sequence, the steps of uncoiling the hot coiled feedstock and quenching the annealed feedstock immediately and rapidly to a temperature sufficient for cold rolling and cold rolling the feedstock to produce sheet stock.

17. A method as defined in claim 16 which includes the further step of forming cups from the aluminum alloy stock.

18. A method as defined in claim 16 which includes the step of coiling the aluminum alloy stock after cold rolling.

19. A method as defined in claim 16 which includes the further in-line step of shearing the cold rolling aluminum alloy strip to lengths.

20. A method as defined in claim 1 wherein the width of the feedstock is less than 24 inches.

21. A method as defined in claim 16 wherein the width of the feedstock is less than 24 inches.

* * * * *